US007540584B2

(12) United States Patent
Bertelsen et al.

(10) Patent No.: US 7,540,584 B2
(45) Date of Patent: Jun. 2, 2009

(54) ORIFICE PLATE PROTECTION DEVICE

(75) Inventors: Craig M. Bertelsen, Union, KY (US); Richard Michael Moore, Bardstown, KY (US); Dell T. Rosa, Winchester, KY (US); Jeffery L. Sangalli, Louisville, KY (US); Jerry E. Stokesbary, Lexington, KY (US); Melissa M. Waldeck, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 314 days.

(21) Appl. No.: 11/095,955

(22) Filed: Mar. 31, 2005

(65) Prior Publication Data

US 2006/0221119 A1 Oct. 5, 2006

(51) Int. Cl.
*B41J 2/165* (2006.01)

(52) U.S. Cl. ..... 347/29

(58) Field of Classification Search ..... 347/29, 347/32, 33

See application file for complete search history.

(56) References Cited

U.S. PATENT DOCUMENTS 4,374,223 A 2/1983 Van Raamsdonk et al.
5,262,802 A 11/1993 Karita et al.
5,400,060 A * 3/1995 Carlotta ..... 347/29
5,439,956 A * 8/1995 Noguchi ..... 522/92
5,536,759 A * 7/1996 Ramharack et al. ..... 522/35
6,634,732 B2 10/2003 Farr et al.

FOREIGN PATENT DOCUMENTS

EP 638426 2/1995
EP 1128426 8/2001
JP 62153374 A * 7/1987
JP 63043987 A * 2/1988
JP 404198976 A * 7/1992

* cited by examiner

*Primary Examiner*—Shih-wen Hsieh
(74) *Attorney, Agent, or Firm*—Luedeka, Neely & Graham PC

(57) ABSTRACT

An orifice plate sealing tape for an orifice plate of a micro-fluid ejection device and methods for sealing an orifice plate with the sealing tape. The sealing tape includes a flexible polymeric backing film and a radiation cured adhesive applied to a surface of the orifice plate. The adhesive is cured in a pattern sufficient to seal adjacent to nozzle holes in the orifice plate and to enhance removal of the backing film and adhesive from the orifice plate prior to use of the micro-fluid ejection device. Upon removal of the sealing tape, a minimum of residue is left on the nozzle plate surface adjacent to and/or in the nozzle holes.

24 Claims, 8 Drawing Sheets

ORIFICE PLATE PROTECTION DEVICE

FIELD OF THE DISCLOSURE

The disclosure relates to micro-fluid ejection heads and in particular to protection devices for orifice plates of the ejection heads.

BACKGROUND AND SUMMARY

Micro-fluid ejection devices have continued to find application in a variety of fields including, but not limited to, ink jet printing, micro-fluid heat transfer, micro-biological preparations, pharmaceutical delivery and the like. As higher quality ejection devices are produced, it becomes increasingly important to protect the orifice plates on the ejection heads during handling, storage, and shipping of the devices so that contamination of fluids or plugging of orifices does not occur. Conventionally, cover tapes are applied to the orifice plates and are removed prior to use of the devices. The cover tapes should be sufficient to adequately seal the orifices to prevent evaporation and intermixing of fluids and should be constructed of materials that are resistant to and do not contaminate the fluids. Removal of the cover tapes should also not leave undesirable residue on the orifice plate.

Pressure sensitive adhesive (PSA) tapes have been used as cover tapes. The PSA tapes are generally constructed of a base film with an acrylate based PSA layer used to seal the orifices on the orifice plate. The base film is typically made of polyethylene terephthalate commonly referred to as polyester (PET) or polyvinyl chloride (PVC).

The acrylic PSA layer is a polymer that can swell (absorb liquids). Accordingly, the PSA layer may be viewed as a polymeric sponge above its glass transition temperature. Typically, the glass transition temperature of acrylic PSA's is at or below about 0° C. Therefore, at any temperature above the glass transition temperature, the adhesive has a high propensity to swell and to flow. During micro-fluid ejection head manufacturing, the ejection head is at or above room temperature. Hence, the PSA layer attached to the orifice plate is constantly absorbing fluid components until an equilibrium point is reached and the adhesive is saturated. Once saturated at the elevated temperature, the acrylic PSA material can flow into the nozzle holes and plug or clog the nozzle holes.

Another disadvantage of an acrylic based PSA cover tape is that a cohesive strength of the PSA is weak with respect to the base film. When the tape is removed from the nozzle plate, the adhesive may be left in the nozzle holes causing a clogged nozzle and/or misdirected fluid. As the nozzle holes get smaller, it is harder to remove PSA material that has swelled in the nozzle holes.

Accordingly, there is a need for improved orifice plate protection devices containing improved adhesives that reduce fluid leakage, fluid evaporation, contamination, and fluid intermixing, and that are easily removable from the orifice plate while minimizing the amount of unwanted residue left on the orifice plate. There is also a need for improved methods for sealing the nozzle holes of an orifice plate for a micro-fluid ejection head.

With regard to the foregoing, the disclosure provides an orifice plate sealing tape for an orifice plate of a micro-fluid ejection device. The sealing tape includes a radiation curable adhesive for application adjacent to a surface of the orifice plate and a flexible polymeric backing film in adhesive contact with the adhesive. The adhesive is curable in a pattern sufficient to seal adjacent to nozzle holes in the orifice plate and to enhance removal of the backing film and adhesive from the orifice plate prior to use of the micro-fluid ejection device.

In another embodiment, there is provided a method of sealing an orifice plate for a micro-fluid ejection device to prevent leakage and evaporation of fluid from the device during handling and shipping. The method includes applying a radiation curable adhesive and backing film to a surface of the orifice plate. The adhesive is cured in a pattern sufficient to seal adjacent to nozzle holes in the orifice plate and to enhance removal of the backing film and adhesive from the orifice plate prior to use of the micro-fluid ejection device.

In yet another embodiment, there is provided a method for enhancing sealing tape and adhesive removal from an orifice plate for a micro-fluid ejection device. The method includes applying a patterned adhesive and backing film to a surface of the orifice plate. The adhesive and film are exposed to radiation sufficient to at least partially cure the adhesive.

Another exemplary embodiment provides a micro-fluid ejection head attached to a fluid cartridge body. The micro-fluid ejection head has an orifice plate with a backing film and radiation curable adhesive applied to a surface of the office plate for sealing nozzle holes in the orifice plate. The adhesive is curable in a pattern sufficient to seal adjacent to nozzle holes in the orifice plate and to enhance removal of the backing film and adhesive from the orifice plate prior to use of the micro-fluid ejection head.

Advantages of exemplary embodiments described herein include, but are not limited to, an ability to adjust the amount of adhesion between a nozzle plate sealing tape and a nozzle plate of a fluid ejection device. Another advantage is that the tape may be removed from the nozzle plate with a minimum of residue left on the nozzle plate and in nozzle holes of the nozzle plate. Yet another advantage is that the cured adhesive may have less affinity for the fluids ejected through the nozzle holes and thus may exhibit less deterioration over time thereby improving the sealing capabilities of the tape.

BRIEF DESCRIPTION OF THE DRAWINGS

Further features and advantages of exemplary embodiments disclosed herein may become apparent by reference to the detailed description when considered in conjunction with the figures, which are not to scale, wherein like reference numbers indicate like elements through the several views, and wherein.

DETAILED DESCRIPTION OF PREFERRED EMBODIMENTS

Figure 1:
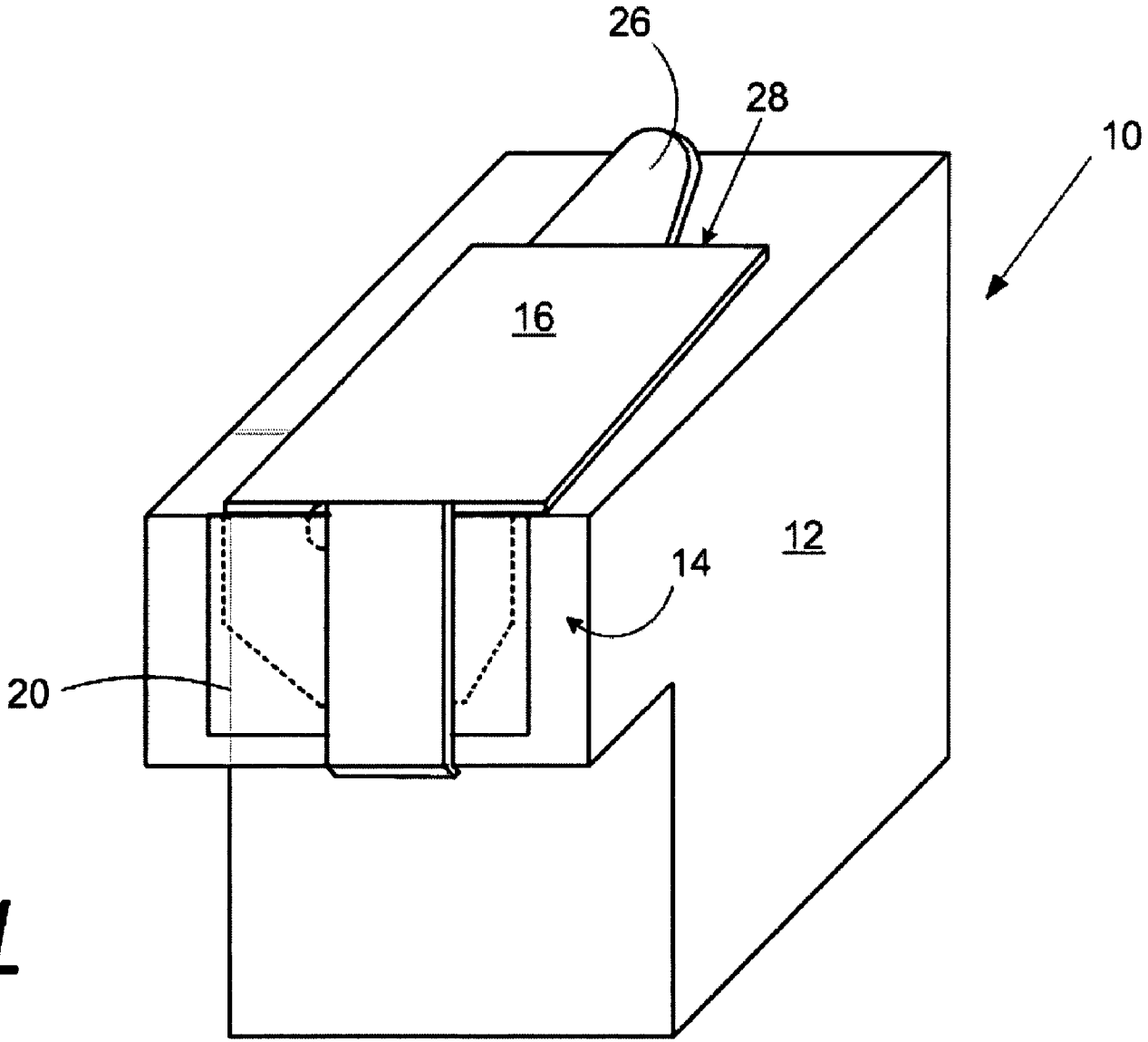
FIG. 1 is a perspective view, not to scale, of a micro-fluid head and fluid cartridge containing a removable sealing tape according to the disclosure.
Figure 2:
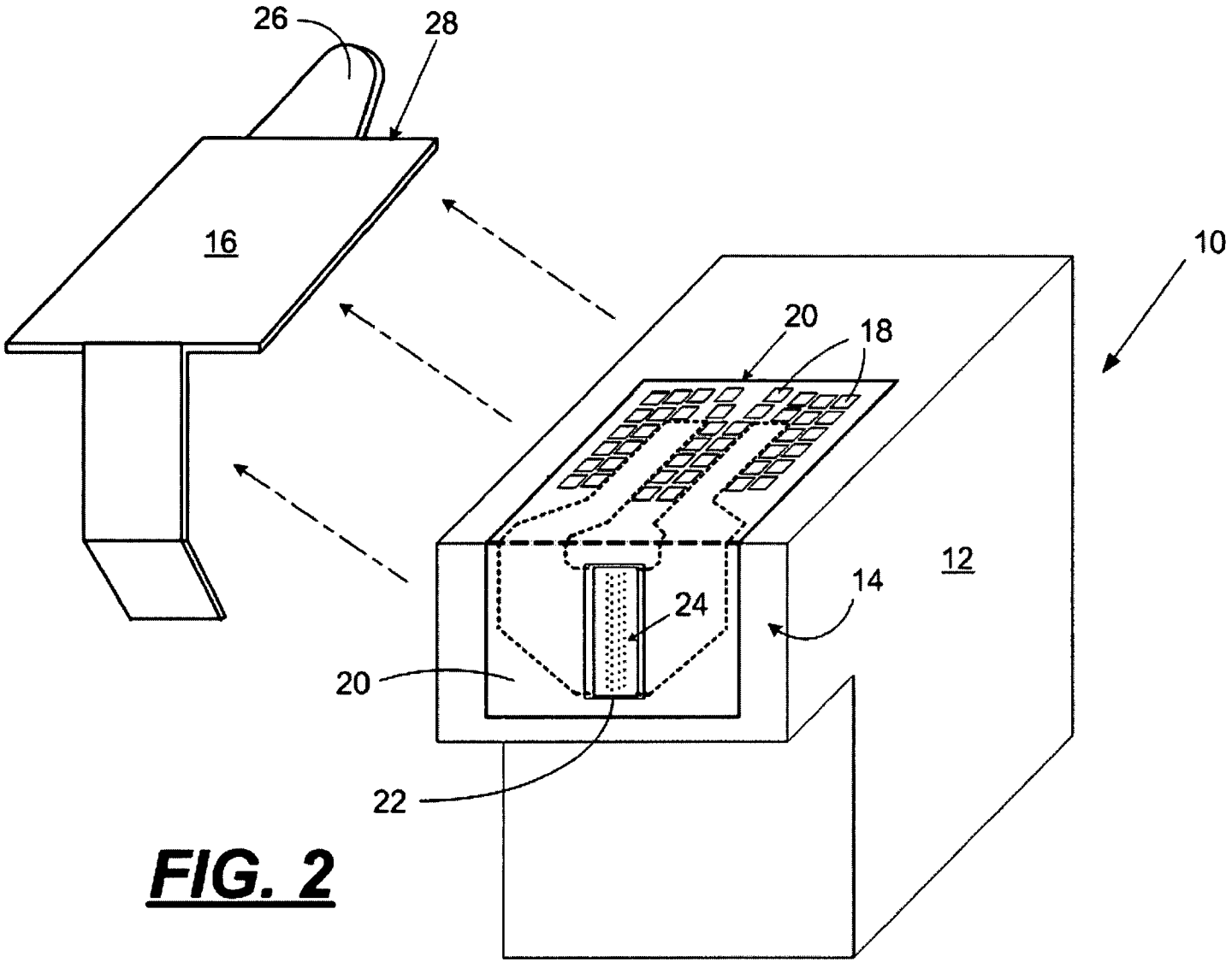
FIG. 2 is a perspective view, not to scale, of a micro-fluid head and fluid cartridge with a sealing tape removed from the head and cartridge.

With reference to FIGS. 1 and 2 there are shown in perspective views, a fluid cartridge 10 including a fluid reservoir body 12 and a micro-fluid ejection head 14. A sealing and protective tape 16 is applied to the fluid cartridge body 12 to cover electrical contacts 18 (FIG. 2) on a flexible circuit 20 and a nozzle plate 22 (FIG. 2) for the ejection head 14.

The protective tape 16 is used to protect the contacts 18 on the flexible circuit 20 from contamination and damage, and to seal nozzle holes 24 in the nozzle plate 22 so that the fluid in the cartridge 10 does not leak out or dry and plug the nozzle holes 24. Before the cartridge 10 is installed in a device, such as a printer, for causing fluid to be ejected through the nozzle holes 24, the tape 16 is pealed away from the cartridge body 12 by grasping a tab 26 on one end 28 of the tape 16 and pulling the tape 16 away from the cartridge body 12 as shown schematically by FIG. 2.

Figure 3:
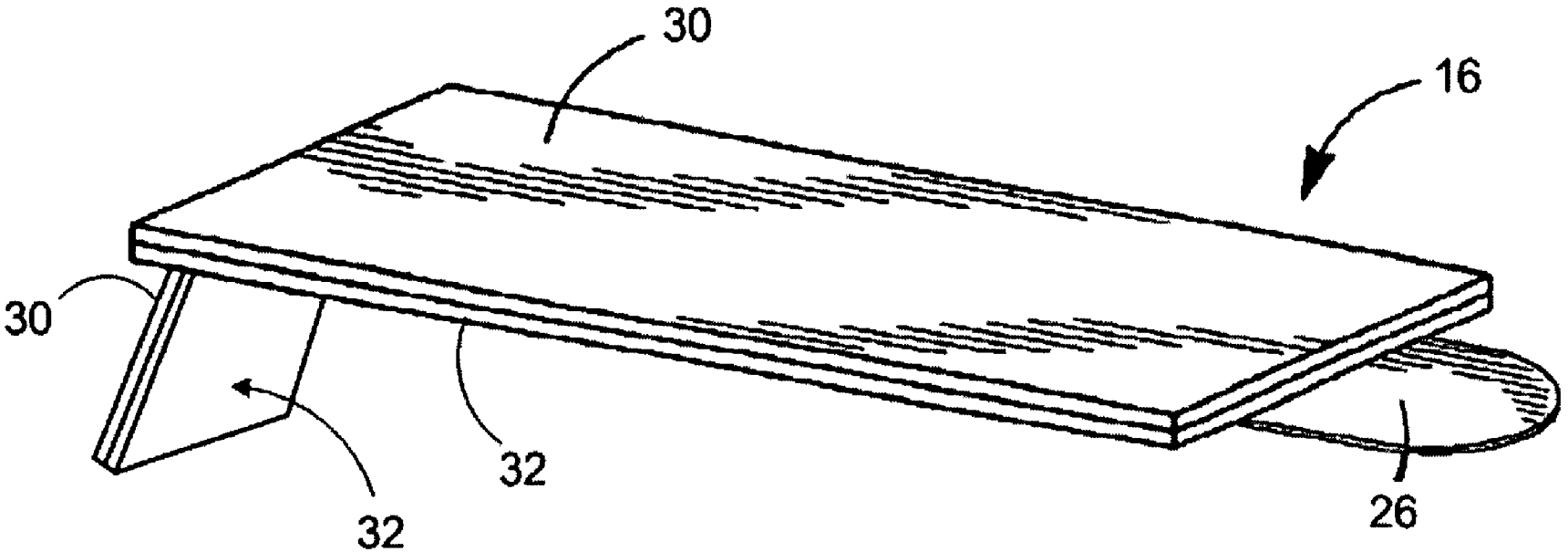
FIG. 3 is a perspective view, not to scale, of a sealing tape according to the disclosure.

As shown in more detail in FIG. 3, the tape 16 may include a backing film 30 and an adhesive layer 32. The backing film 30 may be a radiation transparent thermoplastic film or plurality of thermoplastic films made from one or more materials including, but not limited to, polyethylene terephthalate, polypropylene, polyethylene, polybutene, polybutadiene, polymethyl pentene, polyvinyl chloride, vinyl chloride copolymer, polybutylene terephthalate, polyurethane, ethylene-vinyl acetate copolymer, ionomer resin, ethylene-(meth) acrylic acid copolymer, ethylene-alkyl meth(acrylate) copolymer, polystyrene or polycarbonate. Suitable radiation transparent backing films 30 may be at least about 75 percent transparent to ultraviolet (UV) radiation. The thickness of the film 30 may range from about 40 to about 200 microns.

The second component of the tape 16 shown in FIG. 3 is the adhesive layer 32. In one exemplary embodiment provided herein, the adhesive layer 32 is provided by a UV or other radiation initiated adhesive. The adhesive may be in the form of a B-staged thermoset adhesive that upon irradiation crosslinks to form a cured adhesive. Such irradiation of the adhesive may be used to enhance the adhesion between the adhesive layer 32 and the backing film 30 so an amount of residual adhesive on a surface 34 of the nozzle plate 22 (FIG. 2) is substantially reduced.

In another exemplary embodiment, irradiation of the adhesive may be effective to reduce adhesion between the surface 34 of the nozzle plate 22 and the adhesive layer 32.

In yet another exemplary embodiment, described in more detail below, an adhesive layer may be applied to a surface of the nozzle plate 34 rather than to the backing film 30.

The pressure sensitive adhesive layer 32 may be made from various radiation curable polymers such as epoxy, diolefin, urethane, polyimide, acrylic, silicone and vinyl ester polymers including a polymerization initiator. Examples of acrylic polymers which may be used include homopolymers or copolymers of an alkyl(meth)acrylate, and copolymers of (meth)acrylate and another copolymerizable monomer such as a hydroxyalkyl(meth)acrylate, glycidyl(meth)acrylate, (meth)acrylic acid, itaconic acid, maleic anhydride, (meth) acrylic amide, (meth)acrylic N-hydroxymethylamide, an alkylaminoalkyl(meth)acrylate, silicone adducted acrylate, vinyl acetate, styrene or acrylonitrile.

Acrylic polymers useful as the adhesive typically have a weight-average molecular weight of at least about 200,000 to about 2,000,000. The glass transition point of such an acrylic polymer is about 0° C. or less, and may be from about −100° C. to about −20° C., so that it exhibits tackiness at room temperature (about 25° C.). Pressure-sensitive adhesive polymers may be used either singly or in combination. An acrylic polymer may be converted into a reactive polymer that may be cured by exposure to ultraviolet rays, by introducing a carbon-to-carbon double bond in its main chain or side chain.

Carbon-to-carbon double bonds that may be introduced into the acrylic polymer include, but are not limited to, a monomer or oligomer having, in a molecule thereof, a carbon-to-carbon double bond and being curable by radical polymerization. Specific examples of such monomers or oligomers include esters of (meth)acrylic acid and a polyhydric alcohol such as trimethylolpropane tri(meth)acrylate, pentaerythritol tri(meth)acrylate, tetraethyleneglycol di(meth) acrylate, 1,6-hexanediol di(meth)acrylate, neopentylglycol di(meth)acrylate and dipentaerythritol hexa(meth)acrylate, ester acrylate oligomers, isocyanurate, isocyanurate compounds such as 2-propenyldi-3-butenyl cyanurate, 2-hydroxyetrhylbis(2-acryloxyethyl)isocyanurate and tris(2-methacryloxyethyl)isocyanurate and various urethane oligomers. The above-exemplified materials are usually included in an adhesive formulation in an amount ranging from about 5 to about 200 parts by weight based on 100 parts by weight of the adhesive formulation.

Epoxy polymers may also be used as the base or as an additive to the adhesive layer 32. The epoxy polymers may be converted into reactive polymers by exposure to UV radiation and/or heat thereby opening the epoxy ring to provide reactive sites. Specific examples of epoxy monomers that may be used adhesive layers 32 include diglycidyl ether bisphenol-A (DGEBA) epoxy monomers available from Resolution Performance Products, LLC of Houston, Tex. under the trade names EPON 1001, EPON 1007 and EPON SU-8. Plasticizers may be added to the base epoxy polymers to increase the flexibility of the adhesive layer 32. Such plasticizers include, but are not limited to, low molecular weight DGEBA epoxy resins, polyols, polyacrylates, phenoxy compounds, polybutenes, and mineral oil. An exemplary epoxy adhesive formulation that may be used includes from about 10 to about 50 percent by weight difunctional epoxy compound, from about 5 to about 30 percent by weight plasticizer, from about 1 to about 10 percent by weight photoinitiator, and from about 20 to about 80 percent by weight of non reactive solvent.

In addition to the acrylic and epoxy adhesive materials described above, polyimide and silicone based materials may also be used as base materials for the pressure sensitive adhesive layer 32. In all cases, the adhesive materials may be staged on the backing film 30 to provide the pressure sensitive adhesive tape 16. The adhesive layer 32 may be coated onto the backing film 30 using either flexographic, gravure or screen printing techniques. After coating the backing film 30 with the adhesive layer 32, the backing film 30 is heated to remove the solvent and to "b stage" the adhesive layer 32 on the backing film 30. At this point, the adhesive layer 32 is still tacky, and not fully cured. Curing of the adhesive layer 32 takes place through an ultraviolet radiation exposure.

In order to provide a tape 16 that is radiation curable, a photoinitiator may also be included in the adhesive formulation. A suitable photoinitiator is a photoinitiator that is activated by exposure to ultraviolet radiation. Such photoinitiators include, but are not limited to, 1-hydroxycyclohexyl phenyl ketone, benzoin, benzoin methyl ether, benzoin ethyl ether, benzoin isopropyl ether, benzyldiphenyl sulfide, tetramethylthiuram monosulfide, azobisisobutyronitrile, dibenzyl, diacetyl, beta-chloroanthraquinone, 2-benzyl-2-dimethylamino-1-(4-morpholinophenyl)-butanone-1, and bis(2,4,6-trimethylbenzoyl)-phenylphosphine oxide. The photoinitiator is preferably used in an amount ranging from about 0.4 to about 20 wt. % based on 100 parts by weight of the adhesive formulation. Other components of the adhesive formulation may include plasticizers, surfactants, tackifiers, fillers and/or colorants which are used in conventional amounts.

Typically, a pressure sensitive tape 16 as shown in FIG. 3 is provided with a removable release liner prior to applying the tape 16 to the cartridge body 12. Examples of release liners that may be used with tape 16 include, but are not limited to, release liners made of paper and synthetic resin films such as polyethylene, polypropylene, polyethylene terephthalate or fluorinated polymers. If desired, a surface of the release liner may be subjected to a peel-facilitating treatment such as silicone treatment, long-chain alkyl treatment or fluorine treatment to heighten the releasability of the release liner from the adhesive layer 32. The release liner may have a thickness ranging from about 10 to about 200 microns.

As mentioned above, a nozzle sealing tape constructed of a thermoplastic backer and a UV initiated adhesive are provided. Exemplary embodiments described herein relate to various useful sealing tape constructions and methods of sealing nozzle holes in the nozzle plate 22. In a first exemplary embodiment, a sealing tape is constructed ahead of time by coating an adhesive onto a thermoplastic backer film. The tape is then applied to the nozzle plate surface and then irradiated with UV radiation, for example. In a second exemplary embodiment, an adhesive is dispensed onto the nozzle plate surface and then a backer film is applied to the adhesive and the nozzle plate prior to irradiating the tape with UV radiation.

Figure 5:
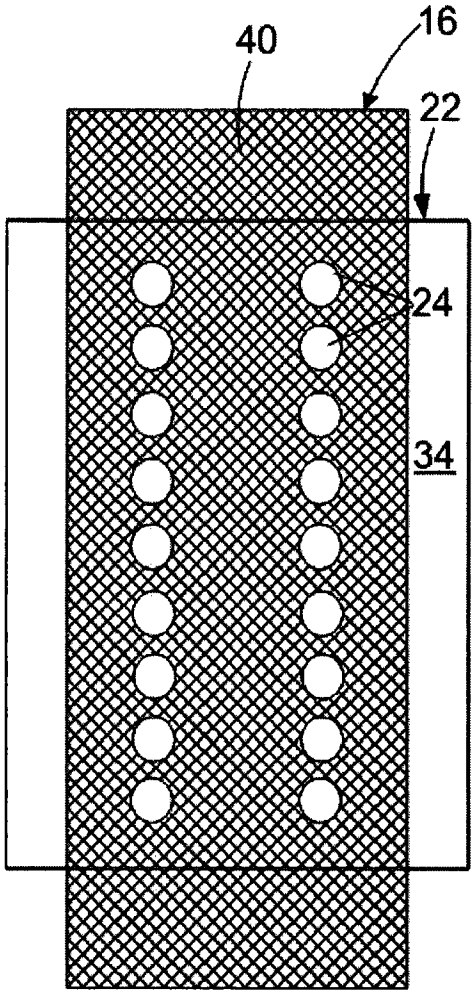
FIGS. 5-9B are plan views, not to scale, of adhesive patterns on nozzle plates for radiation cured adhesives according to exemplary embodiments of the disclosure.
Figure 4:
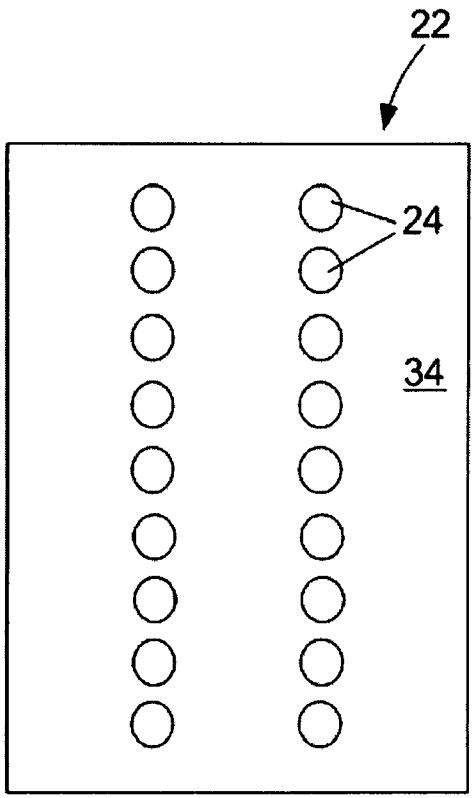
FIG. 4 is a plan view, not to scale, of a nozzle plate for a micro-fluid ejection head according to the disclosure.

With reference to FIGS. 4-9, several exemplary embodiments of the disclosure are illustrated. FIG. 4 is a plan view of the nozzle plate 22 containing the nozzle holes 24. As shown in FIG. 2, the nozzle plate 22 is attached to the micro-fluid ejection head 14 on the fluid cartridge body 12. In a first embodiment, an adhesive consisting of an epoxy, acrylic or polyimide functionality with a free radical initiator is coated on to or laminated to the radiation transparent thermoplastic backing film 30 (FIG. 3). After the adhesive layer 32 is applied to the film 30, the adhesive is heated to remove solvent leaving the adhesive layer 32 in a "B-Stage" state. The tape 16 is then applied to the surface 34 of the nozzle plate 22 as shown in FIG. 5 using a snubber setup to ensure uniform pressure across the nozzle plate surface.

Once initial contact is made between the adhesive layer 32 of the tape 16 and the nozzle plate surface 34, the adhesive would be exposed to UV light or another suitable source of radiation to initiate a crosslinking reaction in the adhesive layer 32 to selectively adjust an adhesive strength of the adhesive. The adhesive strength of the adhesive may be tailored to have a low amount of adhesion between 0.1 to 1 N/mm with the nozzle plate surface 34 in order to enhance complete removal of residual adhesive from the surface 34 of the nozzle plate 22. For example, the adhesive strength of the adhesive may be tailored by adjusting the amount of hydroxyl and epoxy groups in an epoxy resin monomer used as the adhesive. By reducing the available sites for bonding, the adhesion strength may be decreased. However, the adhesive strength should remain sufficient to seal adjacent to the nozzle holes 24 so as to prevent fluid leakage from the nozzle plate 22 and to prevent fluid from drying in the nozzle holes 24.

The tape 16 containing the adhesive layer 32 may be exposed to ultraviolet radiation in a pattern sufficient to seal adjacent to the nozzle holes 24. In FIG. 5, an exposure mask is used to selected cure the adhesive over the surface 34 of the nozzle plate 22 except for a circular area representing the individual nozzle holes 24. A shaded area 40 represents an area of the tape 16 exposed to UV radiation. Accordingly, the exposure mask contains a mask pattern substantially corresponding to the nozzle holes in the nozzle plate 22 to prevent curing of the adhesive immediately adjacent to the nozzle holes.

Figure 6:
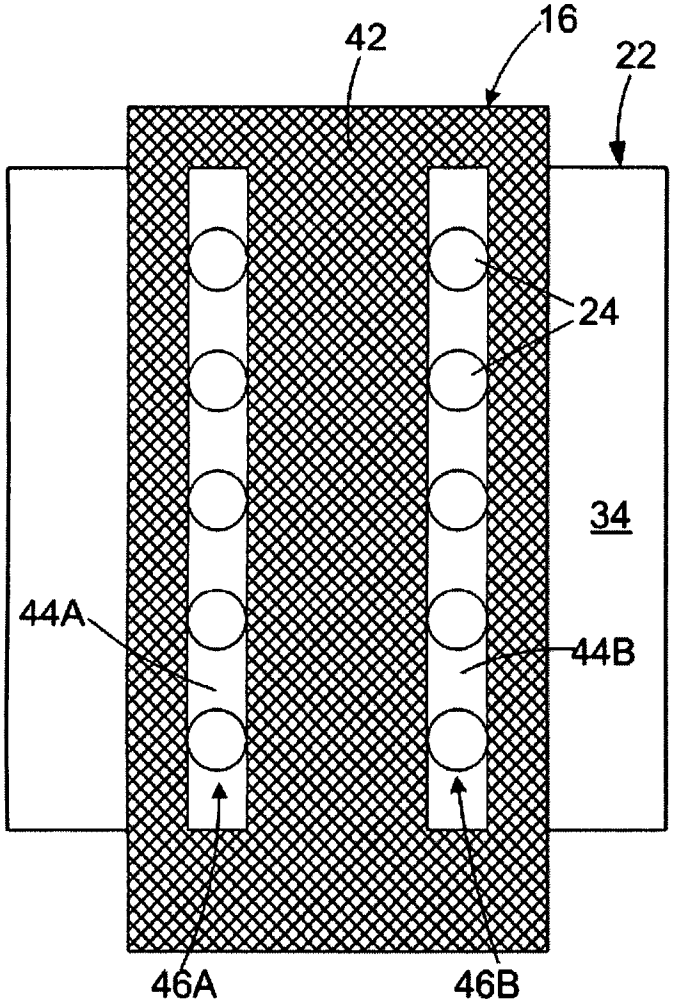

In FIG. 6, the tape 16, as described above, is applied over the nozzle plate 22 centered on the nozzles 24 and is exposed to radiation to cure the adhesive as indicated by shaded area 42. In this exemplary embodiment an exposure mask is used to mask elongate arrays 44A and 44B adjacent to the nozzle holes 24 so that the adhesive is cured only in the shaded areas as shown. The uncured adhesive in the elongate arrays 44A and 44B is sufficient to seal adjacent to the nozzle holes 24 while encircling an entire array 46A and 46B of the nozzle holes 24. If an ejection head 14 contains an array of nozzle holes for multiple different fluids, such as different color inks, each array of nozzles holes is sealed with the elongate array patterns to prevent mixing of fluids from one array of nozzle holes with fluids from another array of nozzle holes.

Figure 7:
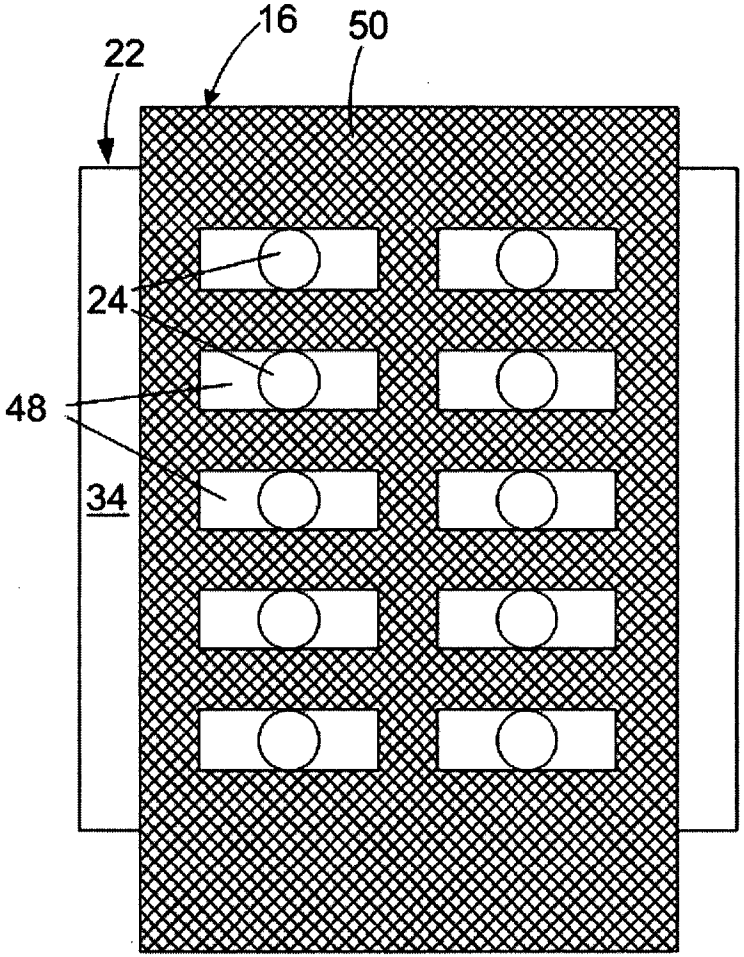

In FIG. 7, a different mask pattern is used to cure the adhesive layer 32 of the tape 16. In this exemplary embodiment, an exposure mask is used to mask a plurality of areas 48 surrounding individual nozzle holes 22 and to cure the adhesive in the shaded area 50 as shown. In order to provide the plurality of uncured areas 48, an alignment of the ejection head 12 to the exposure mask is effected prior to the exposing the tape to radiation.

Figure 8B:
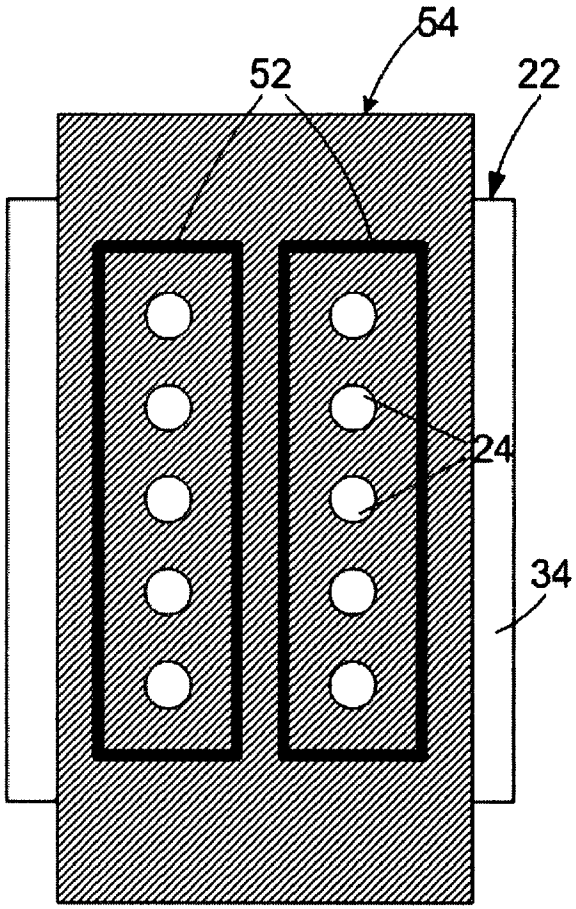
Figure 8A:
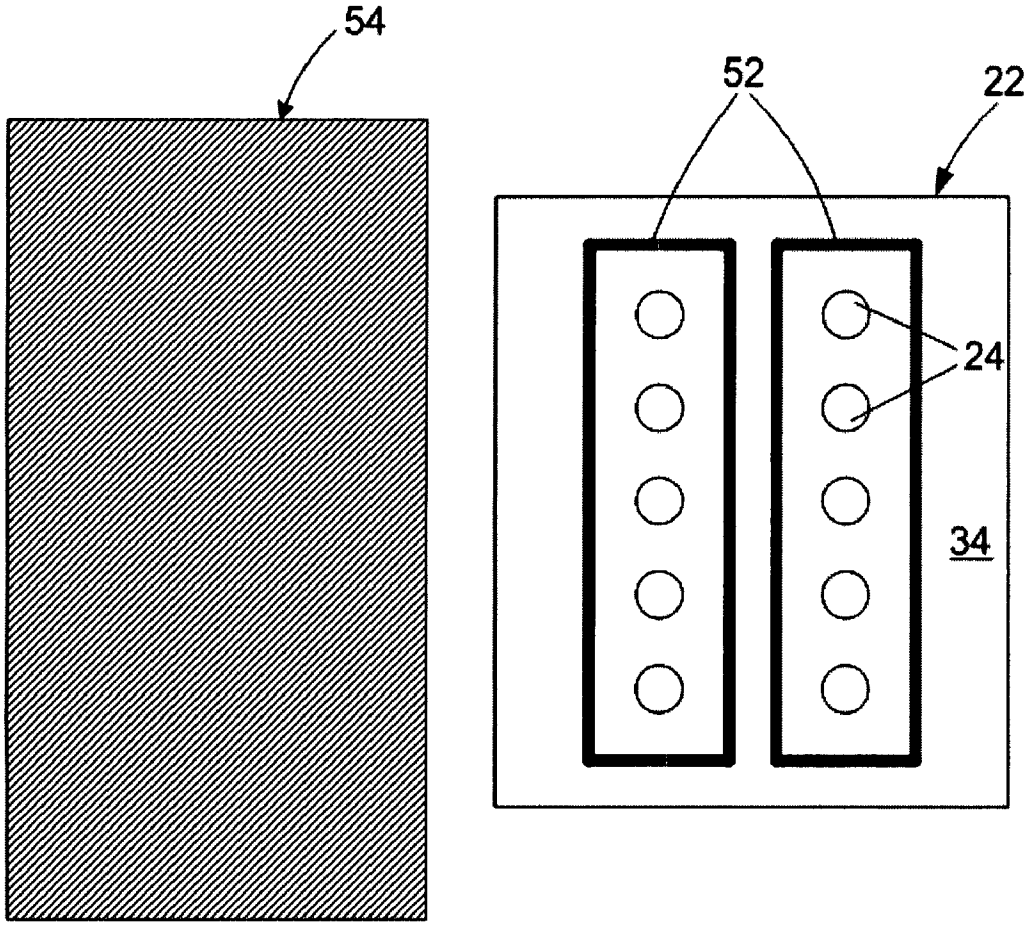
Figure 9B:
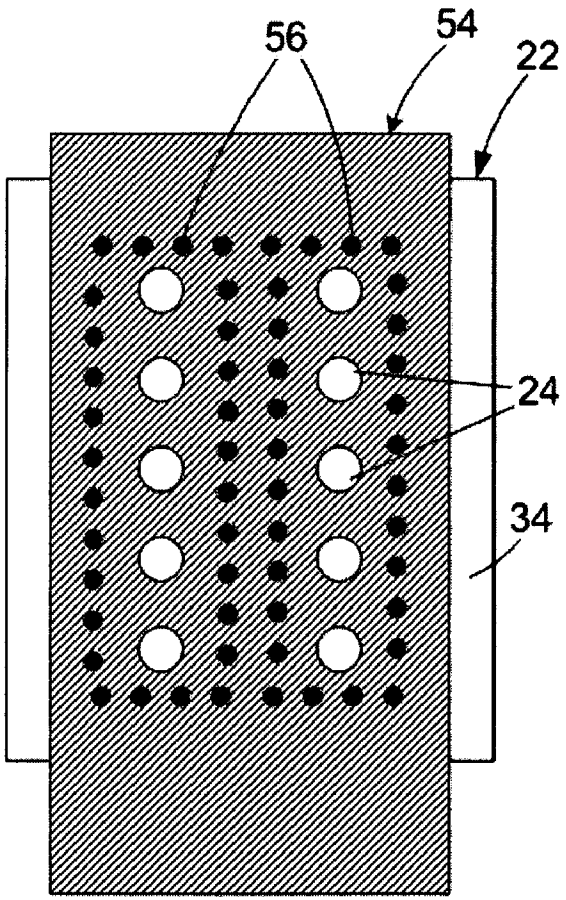
Figure 9A:
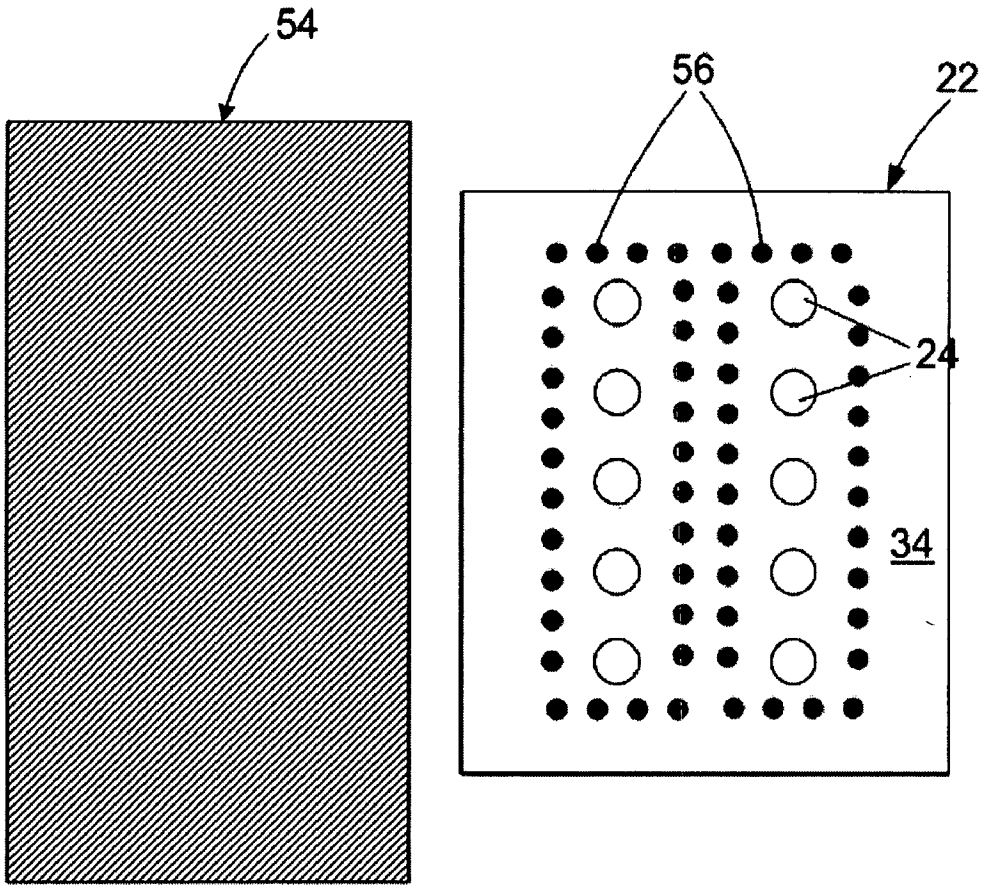

Other exemplary embodiments are illustrated in FIGS. 8 and 9. In these embodiments, a radiation curable adhesive is applied to the surface 34 of the nozzle plate 22 in a pattern that is effective to seal adjacent to the nozzle holes 24. In these embodiments, the adhesive and backing film are separate components. For example, an adhesive pattern is applied to the surface 34 of the nozzle plate 22 wherein the adhesive pattern is a relatively thin adhesive line 52 as shown in FIGS. 8A and 8B or individual adhesive dots 56 as shown in FIGS. 9A and 9B that will flow upon application of a backing film 54 to the adhesive pattern and nozzle plate surface 34. In this case, the backing film 54 is a thermoplastic film that is applied to the adhesive pattern before exposing the backing film 54 and adhesive pattern to radiation to cure the adhesive. In both of the exemplary embodiments shown in FIGS. 8 and 9, the nozzle holes 24 would be sealed off by the adhesive, preventing leakage and cross contamination.

Figure 10:
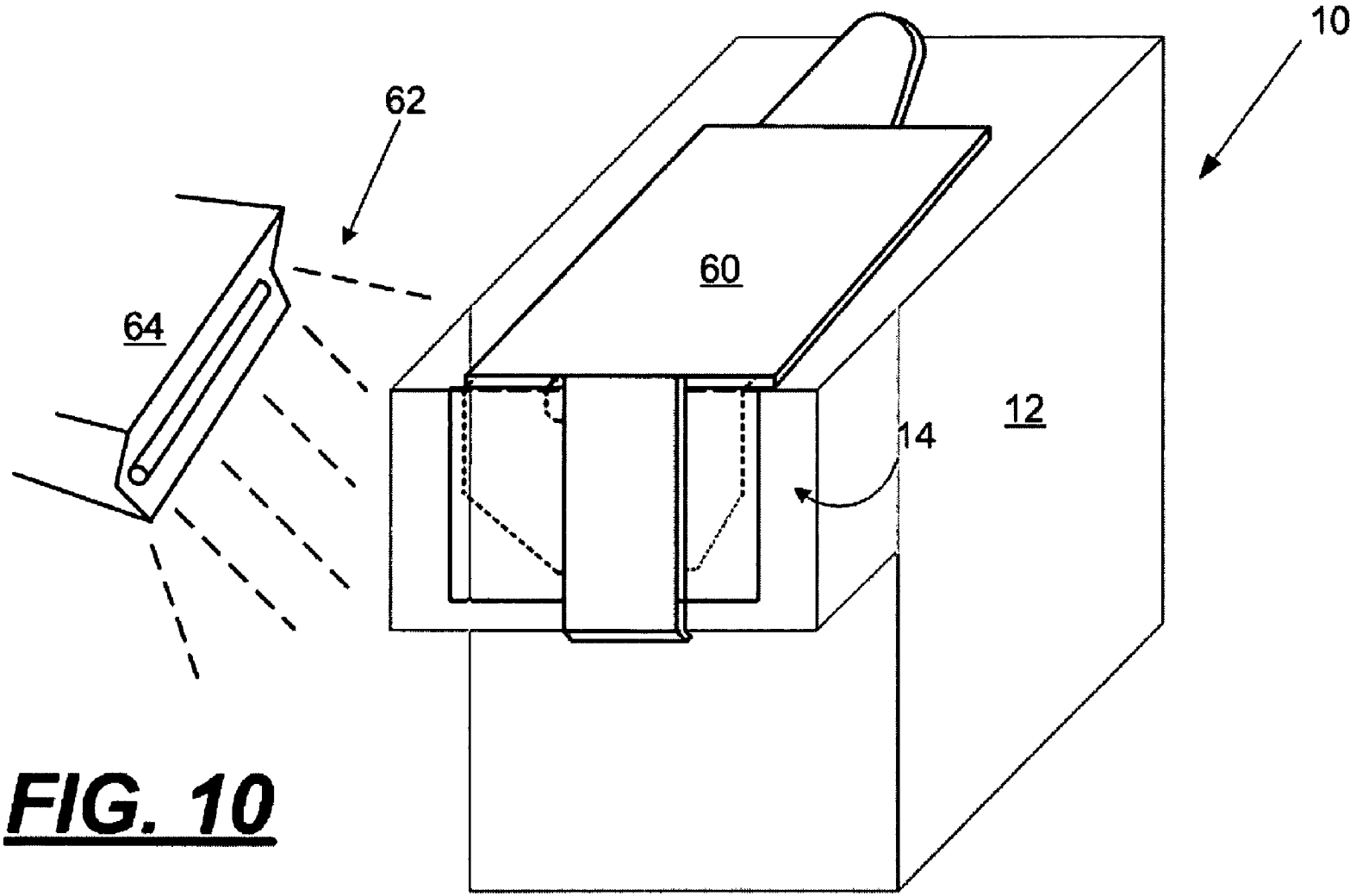
FIG. 10 is a schematic view of a radiation curing step for an adhesive pattern on a nozzle plate according to an exemplary embodiment of the disclosure.

In any of the patterned curing of the adhesive illustrated in FIGS. 5-9, the adhesive may be an adhesive that upon exposure increases in adhesive strength to the backing film 30 so that upon removal of the tape 16 from the cartridge body 12, the adhesive is more likely to remain with the backing film 30 than adhere to the surface 34 of the nozzle plate. However, it is contemplated that the adhesive may be selected to decrease in adhesive strength relative to the surface 34 of the nozzle plate upon exposure to radiation. Accordingly, in another exemplary embodiment illustrated schematically in FIG. 10, a commercially available wafer tape, or custom designed/synthesized adhesive tape is used as the sealing and protective tape 60. In this embodiment, the tape 60 is applied to the nozzle plate 22 and flexible circuit 20 as described above. Commercially available wafer tapes typically crosslink on exposure to radiation thereby reducing adhesion between the tape and a surface to which it is attached.

After attaching the tape 60 to the cartridge body 12, the tape 60 is exposed to radiation 62 from a radiation source 64 to lessen or decrease the adhesion of the tape to the nozzle plate surface 34, at least in the unshaded patterns 24, 46 and 48 illustrated in FIGS. 5-7. Suitable wafer tapes include, but are not limited to, wafer tapes used to reduce adhesion, including acrylic based pressure sensitive adhesive tapes. The pattern of exposure of the tape 60 depends on the specific adhesive formulations used for the tape 60. For example, if after exposure the tape 60 has enough adhesion to withstand shipping and storage cycles, a nozzle plate exposure pattern as illustrated in FIG. 5 may be used. However, if after exposure, the tape 60 would not have enough adhesion for shipping and storage, then exposure patterns as shown in FIGS. 6 and 7 may be used wherein adhesion is reduced only in the elongate arrays 46A and 46B or areas 48 as described above.

In all of the embodiments described above, exposure of the ejection head to intense UV radiation may reduce or eliminate bacterial or fungi/mold contamination of the fluids contained in the cartridge body 12. Such benefit of UV radiation is particularly useful in the case of ink as the fluid in the cartridge body 12 as UV radiation may supplement or possibly eliminate the need for a biocide in the ink formulation.

In the above exemplary embodiments, the fluid cartridge 10 containing the ejection head 14 may be used in a fluid ejection device such as an ink jet printer, wherein the fluid ejected is ink. Other micro-fluid ejection devices that may use the ejection head 14 and fluid cartridge 10 may include, without limitation, lubrication ejection heads, cooling ejection heads, and pharmaceutical ejection heads.

Having described various aspects and exemplary embodiments of the disclosure and several advantages thereof, it will be recognized by those of ordinary skills that the exemplary embodiments are susceptible to various modifications, substitutions and revisions within the spirit and scope of the appended claims.

The invention claimed is:

1. An orifice plate sealing tape for an orifice plate of a micro-fluid ejection device, the sealing tape comprising:

an ultraviolet (UV) radiation curable adhesive for application adjacent to a surface of the orifice plate and a flexible polymeric backing film in adhesive contact with the adhesive, wherein the adhesive is UV cured in a predetermined pattern to form a cured portion and an uncured portion, with the uncured portion disposed above nozzle holes wherein the cured portion enhances removal of the backing film and adhesive from the orifice plate prior to use of the micro-fluid ejection device with a minimum amount of adhesive residue remaining in the nozzle holes.

2. The orifice plate sealing tape of claim 1, wherein the UV radiation cured adhesive has an increased affinity for the backing film.

3. The orifice plate sealing tape of claim 1, wherein the UV radiation cured adhesive has a decreased affinity for the surface of he nozzle plate adjacent to the nozzle holes.

4. The orifice plate sealing tape of claim 1, wherein the UV radiation cured adhesive comprises a β-staged thermoset adhesive.

5. The orifice plate sealing tape of claim 1, wherein the pattern comprises an elongate array adjacent to nozzle holes of the orifice plate.

6. The orifice plate sealing tape of claim 1, wherein the pattern comprises a plurality of areas adjacent to individual nozzle holes of the orifice plate.

7. A method of sealing an orifice plate for a micro-fluid ejection device to prevent leakage and evaporation of fluid from the device during handling and shipping , the method comprising the steps of:

applying ultraviolet (UV) radiation curable adhesive and backing film to a surface of the orifice plate; and curing the adhesive with UV radiation in a predetermined pattern to form a cured portion and an uncured portion, with the uncured portion disposed above nozzle holes wherein the cured portion enhances removal of the backing film and adhesive from the orifice plate prior to use of the micro-fluid ejection device with a minimum amount of adhesive residue remaining in the nozzles.

8. The method of claim 7 wherein the adhesive is cured to increase adhesion between the adhesive and the backing film.

9. The method of claim 7 wherein the adhesive is cured to decrease adhesion between the adhesive and the surface of the nozzle plate adjacent to the nozzle holes.

10. The method of claim 7, wherein the pattern comprises an elongate array adjacent to the nozzle holes of the orifice plate.

11. The method of claim 7 wherein the pattern comprises a pattern adjacent to a plurality of individual nozzle holes of the orifice plate.

12. The method of claim 7, wherein the adhesive comprises a polymer selected from the group consisting of epoxy, diolefin, urethane, polyimide, acrylic, silicone, and vinyl ester polymer.

13. A method for enhancing sealing tape and adhesive removal from an orifice plate for a micro-fluid ejection device, the method comprising the steps of:

applying a patterned ultraviolet (UV) curable adhesive and backing film to a surface of the orifice plate containing nozzle holes; and exposing the adhesive and film to UV radiation, to form a cured portion and an uncured portion with the uncured portion disposed above nozzle holes and whereby a minimum amount of adhesive residue remains on the orifice plate and in the nozzle holes.

14. The method of claim 13, wherein the adhesive is cured to increase adhesion between the adhesive and the backing film.

15. The method of claim 13, wherein the adhesive is cured to decrease adhesion between the adhesive and the surface of the nozzle plate adjacent to the nozzle holes.

16. The method of claim 13, wherein the patterned adhesive comprises an elongated array pattern adjacent to the nozzle holes.

17. The method of claim 13 wherein the patterned adhesive comprises a pattern adjacent to a plurality of individual nozzle holes.

18. The method of claim 13, wherein the adhesive comprises a polymer selected from the group consisting of epoxy, diolefin, urethane, polyimide, acrylic, silicone, and vinyl ester polymers.

19. A micro-fluid ejection head attached to a fluid cartridge body, the micro-fluid ejection head comprising an orifice plate having a backing film and ultraviolet (UV) radiation cui able adhesive applied to a surface of the orifice plate for sealing nozzle holes in the orifice plate, wherein the adhesive is curable by UV radiation in a predetermined pattern to form a cured portion and an uncured portion, with the uncured portion is disposed above nozzle holes, wherein the cured portion enhances removal of the backing film and adhesive from the orifice plate prior to use of the micro-fluid ejection head.

20. the micro fluid ejection head of claim 19, wherein the UV radiation cured adhesive has an increased affinity for the backing film.

21. The micro-fluid election head of claim 19, wherein the UV radiation cured adhesive has a decreased affinity for the surface of the nozzle plate adjacent to the nozzle holes

22. the micro fluid ejection head of claim 19, wherein the UV radiation cured adhesive comprises a B-staged thermoset adhesive.

23. The micro-fluid ejection head of claim 19, wherein the pattern comprises an elongate array adjacent to nozzle holes of the orifice plate.

24. The micro-fluid ejection head of claim 19, wherein the pattern comprises a plurality of areas adjacent to individual nozzle holes of the orifice plate.

* * * * *